US005083511A

United States Patent [19]

Hertel et al.

[11] Patent Number: 5,083,511

[45] Date of Patent: Jan. 28, 1992

[54] APPARATUS AND METHOD FOR PRINTING PLATE CYLINDER—IMPRESSION CYLINDER REGISTRATION

[75] Inventors: James E. Hertel; Dale E. Zeman, both of Green Bay, Wis.

[73] Assignee: Paper Converting Machine Company, Green Bay, Wis.

[21] Appl. No.: 526,119

[22] Filed: May 21, 1990

[51] Int. Cl.[5] ..... B41F 13/24; B41L 3/02

[52] U.S. Cl. ..... 101/486; 101/248; 101/174

[58] Field of Search ..... 101/486, 248, 178, 181, 101/174, 183, 184, 212, 216

[56] References Cited

U.S. PATENT DOCUMENTS

| | | | |
|---|---|---|---|
| 1,952,028 | 3/1934 | Hehle et al. | 101/178 |
| 2,962,962 | 12/1961 | Smith | 101/178 |
| 2,989,918 | 6/1961 | Polglase, Jr. | 101/248 |
| 3,098,434 | 7/1963 | Lime | 101/178 |
| 3,179,045 | 4/1965 | Evers | 101/181 |
| 3,934,502 | 1/1976 | Marino | 101/178 |
| 4,520,728 | 6/1985 | Ecker et al. | 101/248 |

*Primary Examiner*—Edgar S. Burr
*Assistant Examiner*—Christopher A. Bennett
*Attorney, Agent, or Firm*—Tilton, Fallon, Lungmus & Chestnut

[57] ABSTRACT

Apparatus and method for printing plate cylinder—impression cylinder registration for a multi color flexographic press wherein pin means are provided on the plate cylinder gear and finger means provided on the impression cylinder gear and when the two come in contact upon rotation of the impression cylinder gear, the plate cylinder gear rotates through a small arc during which time the gears are brought into meshing engagements.

8 Claims, 3 Drawing Sheets

APPARATUS AND METHOD FOR PRINTING PLATE CYLINDER—IMPRESSION CYLINDER REGISTRATION

BACKGROUND AND SUMMARY OF INVENTION

This invention relates to an apparatus and a method for printing plate cylinder—impression cylinder registration and, more particularly, to an automatic gear mesh and registration system for flexo presses.

This invention is an improvement on co-owned U.S. Pat. No. 4,520,728 which required plate roll setup on a fixture external to the press. The instant invention does not require that type of plate roll setup and constitutes a simple, cost effective procedure. The invention differs from the '728 procedure in that it provides for plate roll registration and gear mesh sequentially rather than simultaneously. The '728 patent used preset plate hubs (adjusted on the fixture) to orient each plate cylinder so that, for a single impression drum position, all plate cylinders could be brought into mesh simultaneously. The inventive procedure meshes one gear at a time as a finger means on the impression drum bull gear moves from deck to deck.

According to the invention, a pin is provided on the plate roll gear contacting finger means on the impression drum gear. The pin/gear assembly is mounted to the plate roll so that the relationship from the pin to the start of the print frame is the same for each color deck. The finger or latch is positioned so that, with gears in close proximity and the pin contacting the finger, the gears will mesh without interference.

The invention is described in conjunction with the accompanying drawing, in which FIG. 1 is a side elevational view (somewhat schematic) of a multi-color deck printing press;

DETAILED DESCRIPTION

Figure 1:
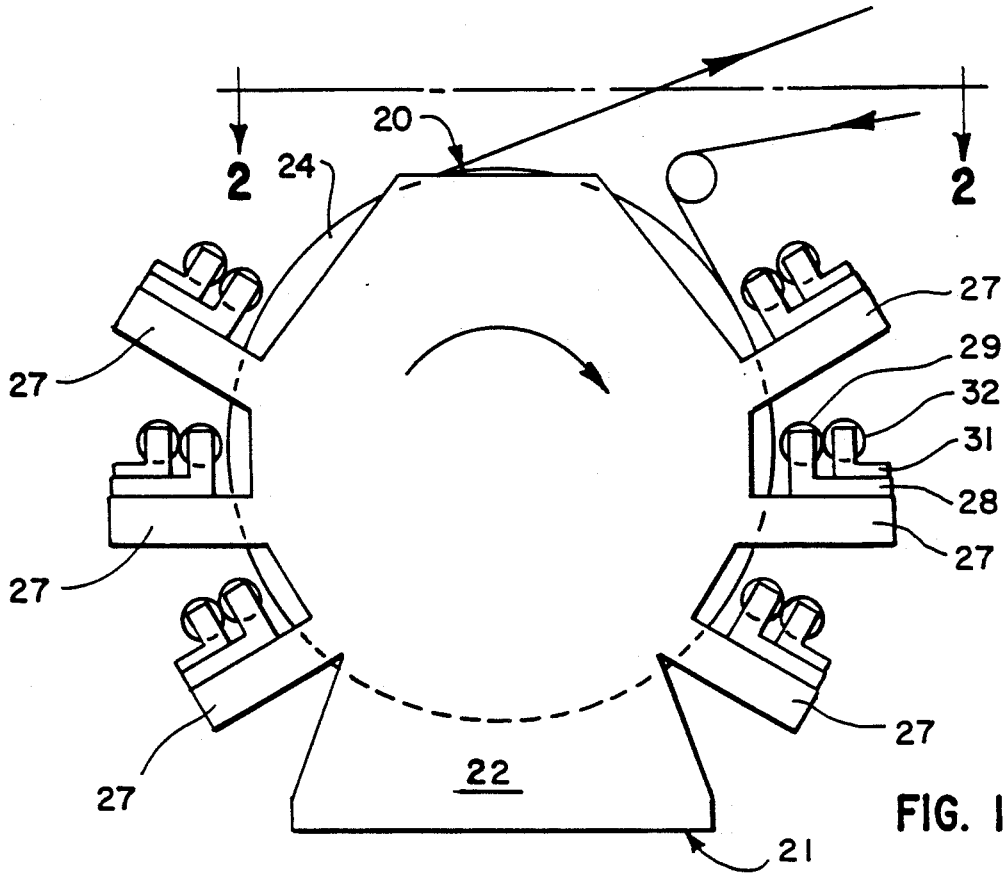

Referring first to FIG. 1 of the drawing the numeral 20 designates generally a multi-color flexographic press which is depicted schematically. Further details can be seen from prior U.S. Pat. No. 4,520,728 and express reference is hereby made thereto. The numeral 21 designates generally the frame of the press which consists of side frames 22 and 23 (see FIG. 2) with various connecting members (not shown). The numeral 24 in both FIGS. 1 and 2 designates a central impression cylinder which is seen to be equipped with a fairly large gear designated 25 in FIG. 2. The central impression cylinder gear is conventionally referred to as the "bull gear". Shown schematically as at 26 is a drive for the central impression cylinder and bull gear 25.

The numeral 27 designates a portion of the side frames, 22, 23 which support a color deck, a plurality of which are provided as can be seen from FIG. 1. Slidably movably mounted on each frame deck portion 27 is a subframe 28 carrying a plate cylinder or roll 29. Each plate cylinder is equipped with a gear 30 which is adapted to mesh with the bull gear 25.

Slidably, movably carried by the subframe 28 is a second subframe 31 which in turn rotatably supports an anilox roll 32. The anilox roll 32 is equipped with a gear 33 which is seen in meshing engagement with the plate cylinder gear 30. The anilox gear is provided with a fountain or fountain roll in conventional fashion and further details may be seen in the '728 patent.

OPERATION GENERALLY

First the plate rolls 29 are loaded into place as indicated in FIG. 1 and the plate and anilox roll gears meshed —the anilox roll requires no registration so the operator can bring it into mesh with the plate roll gear without regard to any particular registration. The anilox rolls 32 are moved toward the plate rolls to the point where there is a minor mesh (of the order of about 0.015") between the gears 30, 33. The anilox roll 32 is rotated slowly by a Sunday drive motor 34 (see FIG. 2) which causes the plate roll 29 to rotate.

Figure 3:
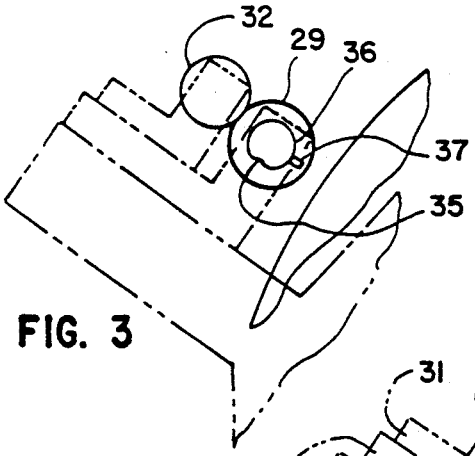
FIG. 3 is a fragmentary relatively enlarged side elevational view of one deck of the six decks of the machine seen in FIG. 1.

Usually the anilox roll 32 and the plate roll 29 are in the configuration of FIG. 3 where the detent 35 of a contoured element 36 is not aligned with a locating device 37. Thus, the plate roll 29 continues to rotate until it is stopped by the locating device 37 and the Sunday drive motor 34 is disengaged.

Figure 2:
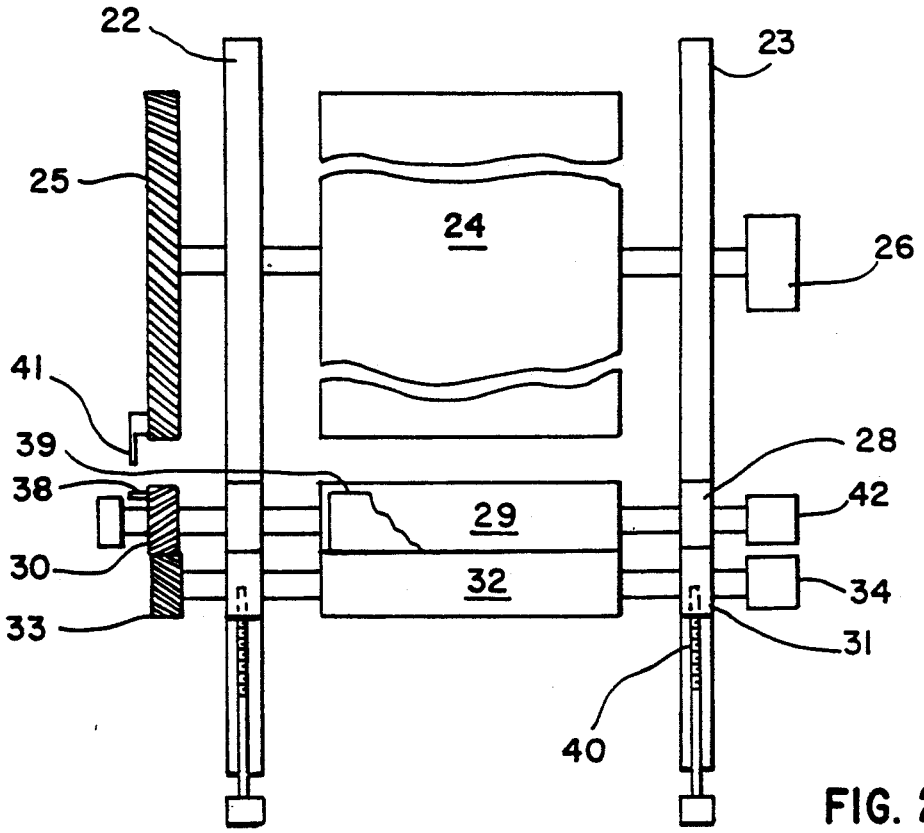
FIG. 2 is a top plan view (essentially schematic) of the press of FIG. 1 and as would be generally seen from the sight line 2—2 applied to FIG. 1.

The locating device 37 presents the alignment pin 38 (see the lower left hand portion of FIG. 2) on the plate roll gear 30 at a specific location relative to the start of the print frame 39 on the plate roll or cylinder 29 (still referring to FIG. 2).

Figure 4:
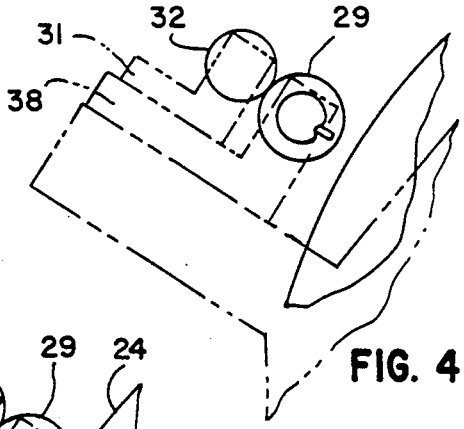
FIG. 4 is a view similar to FIG. 3 but showing the parts thereof in a subsequent state of operation.
Figure 5:
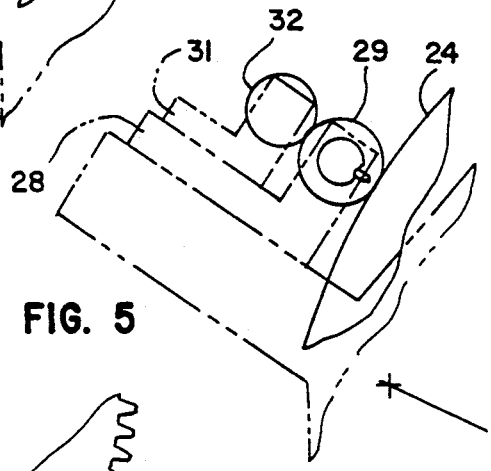
FIG. 5 is a view similar to FIGS. 3 and 4 but showing the parts thereof and yet a further state of operation.
Figure 6:
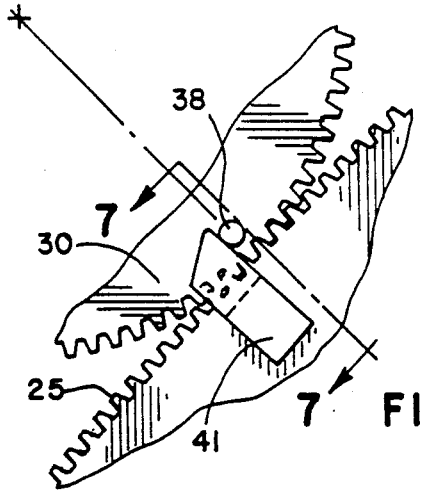
FIG. 6 is an enlarged fragmentary view of the plate cylinder and impression cylinder gears at the beginning of the registration proceeding.
Figure 8:
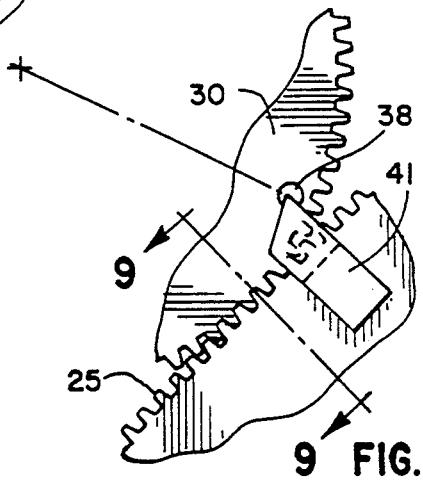
FIG. 8 is a view similar to FIG. 6 but with the parts thereof in different operational condition.
Figure 7:
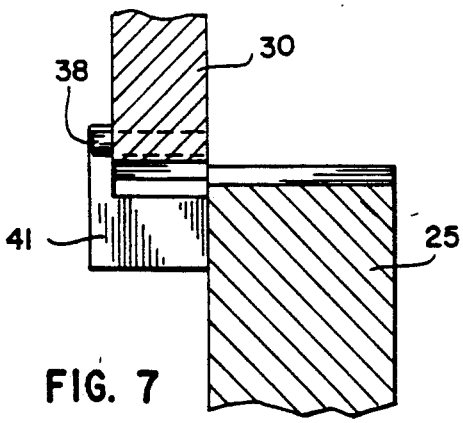
FIG. 7 is a fragmentary sectional view taken along the sight line 7—7 of FIG. 6.
Figure 9:
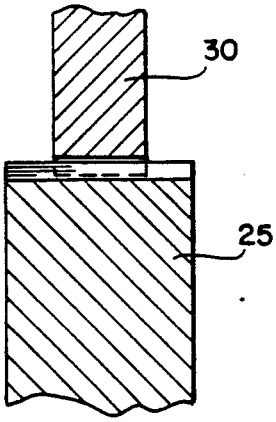
FIG. 9 is a view similar to FIG. 7 but taken along the sight line 9—9 of FIG. 8.
Figure 10:
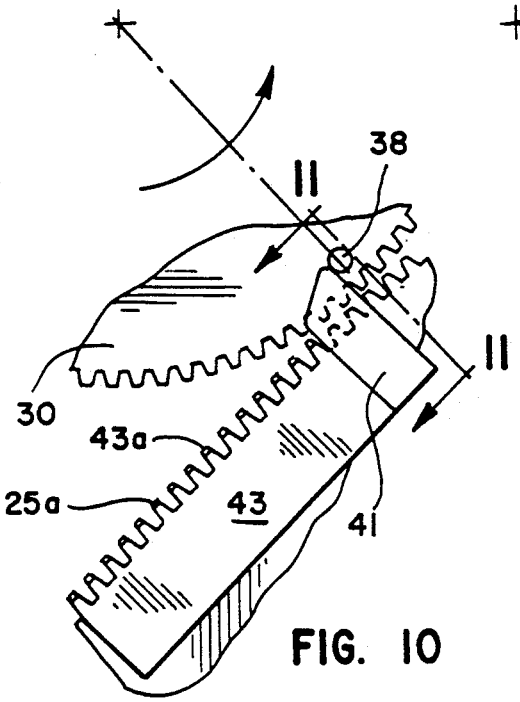
FIG. 10 is a view similar to FIG. 6, i.e., a fragmentary view of the plate cylinder and central impression cylinder gears but of a modified form of the invention.
Figure 12:
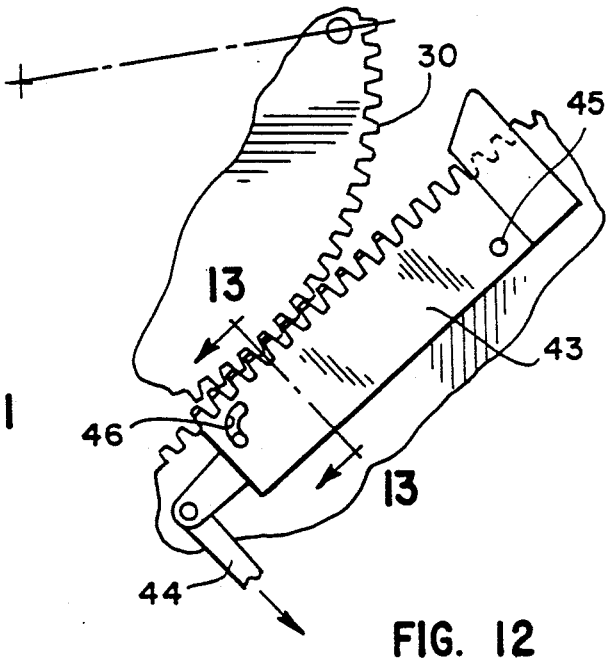
FIG. 12 is a view similar to FIG. 10 but of a different stage in the operation of the invention.
Figure 11:
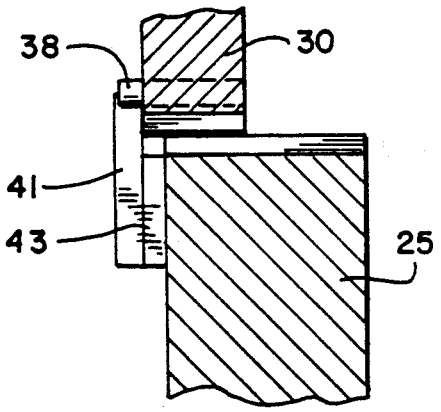
FIG. 11 is a sectional view taken along the sight line 11—11 of FIG. 10.
Figure 13:
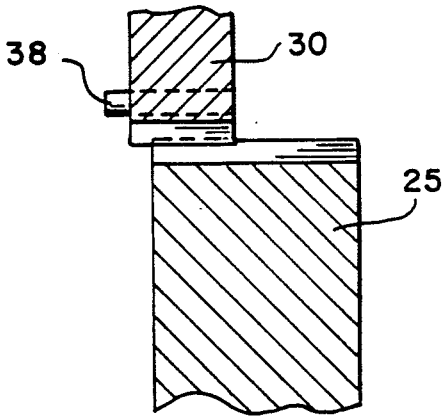
FIG. 13 is a sectional view taken along the sight line 13—13 of FIG. 12.

Thereafter, all of the decks are moved toward the impression cylinder 24. This is achieved in conventional fashion by motor driven screw/nut means as at 40 (see the lower right hand portion of FIG. 2 and for further details the '728 patent). Thus, the plate cylinder 29 has been moved into close proximity to the central impression cylinder 24—see FIG. 5, the state of the plate and anilox rolls 29, 32 prior to movement being depicted in FIG. 4. More particularly, the plate roll gear 30 and the bull gear 25 are in the orientation shown in FIGS. 6 and 7. In FIG. 7, for example, the gears are seen to be axially offset and a pickup finger 41 mounted on the side of the bull gear 25 is about to engage the pin 38 extending axially from the plate cylinder gear 30. The engagement of the finger 41 with the pin 38 causes the plate cylinder 30 (and hence the plate cylinder 29) to rotate with the bull gear 25 (and hence the central impression cylinder 24). This occurs over a minor arc during which time a side shifting mechanism 42 (see the right hand portion of FIG. 2) shifts the plate roll 29 and its gear 30 into the configuration seen in FIG. 9. At this stage, the finger 41 can pass by the pin 38 without interference—as is depicted in FIG. 8.

A modified embodiment is seen in connection with FIGS. 10–13. There the pin 38 (see FIG. 10) is waiting in position for the finger 41. Extending rearwardly from the pin 38 on the bull gear 25 is a rack segment 43. The finger 41 on the bull gear continues to drive the plate roll until mesh between the plate roll gear 30 and the gear rack 43 is achieved—compare FIGS. 10 and 12. The gear rack 43 is mounted on the side of the bull gear 25 with a tooth profile as at 43*a* which extends approximately 0.030" radially outward of the teeth 25*a* on the bull gear 25.

Once in mesh with the gear rack 43, the plate roll 29 is moved toward the impression roll 24. Using the gear rack 43 as a guide, the plate roll gear is moved into mesh with the bull gear 25. Thereafter the rack 43 is retracted from its engaged relation by the linkage 44 (see FIG. 12) operated by an air cylinder (not shown). The mounting of the rack 43 on a pivot 45 causes the rack to be pivoted out of further engagement with the plate roll gear 30 by virtue of the pin and guide arrangement 46. This is the configuration depicted in FIG. 13.

More generally, the invention contemplates in the pin/finger engagement that either element can be located on either gear and that the mesh engagement once pin/finger contact has been made can be either achieved by side shifting or radial movement.

Typically on flexopresses, the plate cylinders are meshed with the central impression gear so that the plates are close to perfect registration, i.e., the side-to-side mis-registration is within plus or minus ¼" and the circumferential registration is within one tooth on the plate gear. Then the press operator will adjust the side registration using a hydraulic cylinder or motor/screw to side shift the plate roll. The circumferential registration is adjusted small amounts by side shifting the plate gear via a hydraulic cylinder or motor/screw. The plate gears are helical and, hence, provide a small rotary motion associated with the side shift motion.

We claim:

1. Apparatus for meshing plate cylinder gears to the gear of a central impression cylinder in printing register comprising a frame, a gear-equipped central impression cylinder rotatably mounted on the said frame, a plurality of gear-equipped plate cylinders each having a printing plate thereon circumferentially disposed about said central impression cylinder on said frame, pin means operably associated with each plate cylinder gear aligned with register mark means on the plate cylinder printing plate, means on said frame for positioning each plate cylinder pin means in predetermined orientation, finger means operably associated with said central impression cylinder gear for sequentially engaging each plate cylinder pin means to rotate each plate cylinder through a minor arc, and means on said frame for moving each plate cylinder gear into meshing engagement with said central impression cylinder gear.

2. The apparatus of claim 1 in which a rack is mounted on said central impression cylinder gear rearward in the direction of rotation from said finger means, said rack being equipped with teeth which project radially outwardly of the teeth on said central impression cylinder gear and aligned therewith, said rack during engagement with said plate cylinder gear providing time for meshing engagement of said plate cylinder gear with said central impression cylinder gear.

3. The apparatus of claim 2 in which said frame is equipped with means for axially moving said plate cylinder gear into meshing engagement with said central impression cylinder gear.

4. The apparatus of claim 2 in which said rack is resiliently mounted on said central impression cylinder gear for limiting the force applied to said pin means during acceleration of said plate cylinder.

5. The apparatus of claim 1 in which said frame is equipped with means for radially moving said plate cylinder gear into meshing engagement with said central impression cylinder gear.

6. The apparatus of claim 1 in which said frame includes a sub frame for each plate cylinder, said means for positioning each plate cylinder pin in a predetermined orientation including a location device on each sub frame, each plate cylinder being equipped with a contoured element engageable by said location device for stripping said plate cylinder in said predetermined orientation.

7. The apparatus of claim 6 in which said location device is equipped with means for force loading against said contoured element.

8. A method for achieving registration in a multicolor printing press having a central impression cylinder and a plurality of plate cylinders, each of said impression and plate cylinders being equipped with a gear comprising providing each plate cylinder with an axially extending pin means aligned with register mark means on its associated plate cylinder printing plate and rotating said plate cylinder into a predetermined orientation relative to said central impression cylinder, providing the central impression cylinder gear with finger means projecting radially beyond the same and aligned with each pin means and rotating said central impression cylinder gear to move each plate cylinder through a minor arc and, sequentially moving each plate cylinder into meshing engagement with said central impression cylinder.

* * * * *